US011117720B2

(12) United States Patent
Pohlman

(10) Patent No.: US 11,117,720 B2
(45) **Date of Patent: *Sep. 14, 2021**

(54) CLOSURE VENT FOR TAMPER EVIDENT CONTAINER

(71) Applicant: Anchor Packaging, LLC, St. Louis, MO (US)

(72) Inventor: Mike Pohlman, Valley Park, MO (US)

(73) Assignee: Anchor Packaging, LLC, St. Louis, MO (US)

( * ) Notice: Subject to any disclaimer, the term of this patent is extended or adjusted under 35 U.S.C. 154(b) by 187 days.

This patent is subject to a terminal disclaimer.

(21) Appl. No.: 16/519,263

(22) Filed: Jul. 23, 2019

(65) Prior Publication Data

US 2019/0344936 A1 Nov. 14, 2019

Related U.S. Application Data

(63) Continuation of application No. 15/705,378, filed on Sep. 15, 2017, now Pat. No. 10,358,271.

(51) Int. Cl.
*B65D 47/32* (2006.01)
*B65D 43/02* (2006.01)
*B65D 43/16* (2006.01)
(Continued)

(52) U.S. Cl.
CPC ..... *B65D 47/32* (2013.01); *B65D 43/0254* (2013.01); *B65D 43/162* (2013.01);
(Continued)

(58) Field of Classification Search
CPC .. B65D 47/32; B65D 51/1666; B65D 55/024; B65D 43/0254; B65D 43/162;
(Continued)

(56) References Cited

U.S. PATENT DOCUMENTS 3,216,148 A 11/1965 Amberg
4,770,318 A 9/1988 Earl
(Continued)

FOREIGN PATENT DOCUMENTS

EP 2389322 11/2011
TW 201033089 9/2010
WO WO2010147667 12/2010

OTHER PUBLICATIONS

EP Search Report dated Feb. 19, 2019 from co-pending EP Patent Application No. 18194146.9.

*Primary Examiner* — James N Smalley
(74) *Attorney, Agent, or Firm* — Sandberg Phoenix and von Gontard, P.C.

(57) ABSTRACT

A plastic container includes a lid adapted for leak-proof sealing state with a base. Mating surfaces of the lid and base rims form one or more proximal seal zones when the lid rim and base rim are in an initially sealed state. Hinge-forming structure extends from a first hinge-joining section of the lid rim to a second hinge-joining section on the base rim. In the initially sealed state the first hinge-joining section superposes over all or part of the second hinge-joining section, the area at which the first hinge-joining-section superposes the second hinge-joining section defines an overlapping portion of the first and second hinge-joining sections. One or more vent channels are formed in either of the lid rim or base rim and located within the radially overlapping portion. The one or more channels form a complete discontinuity in the one or more proximal seal zones. Because the channels are within the overlapping portion, they are protected from tampering access.

11 Claims, 7 Drawing Sheets

(51) Int. Cl.
*B65D 51/16* (2006.01)
*B65D 55/02* (2006.01)

(52) U.S. Cl.
CPC ..... *B65D 51/1666* (2013.01); *B65D 55/024* (2013.01); *B65D 2251/00* (2013.01); *B65D 2401/60* (2020.05); *B65D 2543/0062* (2013.01); *B65D 2543/00101* (2013.01); *B65D 2543/00296* (2013.01); *B65D 2543/00324* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 2543/00546; B65D 2543/00731; B65D 2543/00796; B65D 2543/0062; B65D 2543/00685; B65D 2543/00324; B65D 2543/00101
See application file for complete search history.

(56) References Cited

U.S. PATENT DOCUMENTS

| | | | |
|---|---|---|---|
| 6,164,484 | A | 12/2000 | Fiore |
| 8,875,927 | B2 | 11/2014 | Pohlman |
| 9,580,219 | B2 | 2/2017 | Cimmerer |
| 9,656,785 | B2 | 5/2017 | Cimmerer |
| 9,796,511 | B2 | 10/2017 | Cimmerer |
| 2003/0173325 | A1 | 9/2003 | Mavin |
| 2005/0269319 | A1 | 12/2005 | Tang |
| 2010/0140267 | A1 | 6/2010 | Sellari |
| 2010/0181323 | A1 | 7/2010 | Thaler et al. |
| 2010/0320210 | A1 | 12/2010 | Cimmerer |
| 2011/0068105 | A1 | 3/2011 | Pohlman |
| 2012/0181280 | A1 | 7/2012 | Barbier |
| 2017/0001775 | A1 | 1/2017 | Cimmerer |

CLOSURE VENT FOR TAMPER EVIDENT CONTAINER

CROSS REFERENCE TO RELATED APPLICATION

This application is a continuation of, and claims the benefit of, U.S. patent application Ser. No. 15/705,378, now U.S. Pat. No. 10,358,271, filed on Sep. 15, 2017. The entire contents of that application are herein incorporated by reference.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to vented plastic food containers. The invention is more specifically related to venting mechanisms for disposable tamper evident plastic food containers.

BACKGROUND OF THE INVENTION

It is known to use plastic containers in the food preparation and restaurant industry to package prepared foods. The typical food container of the prior art consists of a clear or solid colored base and a clear lid. In order to maintain the quality of food contents and prevent tampering with the contents of a sealed container, it is desirable that the food container, once initially sealed, not be capable of being initially opened without visible indication of the container having been opened. To achieve this feature, container manufacturers have designed containers having integral tamper evident features. Typically, these containers consist of a lid that is hingedly attached to a base. The lid seals to the base by superposing the rim of the lid upon the rim of the base. These types of plastic containers are sold as one-piece containers and are often referred to as "clamshell" containers or packages.

Some manufacturers of tamper evident clamshell containers have incorporated tamper evident features as part of the structure that forms or includes the hinge. In these containers, the container is designed to require a severance near the hinge in order to unseal (initially open) the container. This construct make the hinge a single use hinge. One example of a container with a tamper evident hinge structure is shown in U.S. Pat. No. 9,580,219 (Cimmerer, et al).

One deficit of the prior art tamper evident container lies in the fact that they are not adapted to hold warm foods or cut produce that create internal vapor or gas (collectively referred to herein as "vapor" pressure). In fact, if the container is not vented properly, the buildup of pressure in a sealed container can overcome the force of the container's rim engagement and cause the container to pop open, thereby defeating its tamper evident quality. On the other hand, one cannot simply utilize the common venting techniques used with standard containers on a tamper evident container. In this respect, in the food packaging industry it is known to provide apertures or slits in the top surface of a plastic container for purposes of venting the container. However, adding such vents to a tamper evident container provides access ports into the container that defeat the purpose of the tamper evident structures of the container. Holes and slits in the container top surface also permit the leakage or spillage of food contents should the container turn over. They also allow the ingress of bacteria into the container.

It is also known in the food packaging industry to provide venting structures in the engaging rims of the container so as to allow for venting through the rims of the container. An example of a container with such structures is disclosed in U.S. Pat. No. 8,875,927 (Pohlman, et al). The venting mechanism of the container of Pohlman is built into the rim-engaging surfaces of the lid and base rims and utilizes internal vapor pressure to cause at least one of the rims to move slightly relative to the other to create a venting path through the rims when the container is under pressure. The known through-the-rim venting solutions, however, do not work with prior art tamper evident containers because the lid rims and base rims of such containers are designed to strongly and immovably engage when the container is sealed. Hence, the rims, once engaged, do not allow for a secondary venting movement vis-à-vis each other once the container is sealed. This is because these rigid rim engagement designs prevent opening of the containers via any technique other than through deployment of the opening mechanism built into the container. Providing for through-the-rim venting around the periphery of the container could therefore focally weaken the frictional engagement of the lid and base rims and thereby circumvent the need to use the provided-for opening mechanism. Also, providing vent channels in the accessible rims could provide possible leverage or insertion points at which to insert a slender tool or object through the rims of the container.

There is thus a need in the art for a tamper evident plastic food container that allows for the elimination of excess vapor pressure yet allows the container to retain its tamper evident functionality.

SUMMARY OF THE INVENTION

The present invention satisfies the need in the art and provides an aesthetically appealing food container that is easy to use, while allowing for removal of excessive steam pressure from a tamper evident container that employs a container opening mechanism in the container's hinge-forming structure. In this respect, the present invention plastic food container comprises a lid adapted for sealing with a base. The lid has a perimeter rim structure that complementarily engages the rim structure of the base to achieve a substantially leak-proof seal via the mating of the lid and base rim structures at certain zones, referred to herein as seal zones.

In particular, a preferred embodiment of the present invention food container is capable of assuming a loading state and an initially sealed state. The container comprises a base and a lid. The base has a base rim peripherally encompassing the base and the lid has a lid rim peripherally encompassing the lid. Hinge-forming structure extends from a first hinge-joining section of the lid rim to a second hinge-joining section on the base rim. In the initially sealed state the first hinge-joining section superposes over all or part of the second hinge joining section. The area of the container at which the first hinge-joining-section superposes the second hinge-joining section defines an overlapping portion of the first and second hinge-joining sections. For brevity's sake this overlapping portion of the first hinge-joining section and the second hinge-joining section is referred to herein as the "overlapping portion."

In the initially sealed state the base rim and lid rim frictionally engage each other such that they form one or more proximal seal zones. One or more vent channels are formed in either of the lid rim or base rim and located within the overlapping portion. When the container is in the sealed state, the one or more channels form a complete discontinuity in the one or more proximal seal zones. To ensure tamper evidence, the plastic food container should not have at vents outside of the overlapping area. Additionally, in a preferred embodiment, when the container is in the initially sealed state, the base rim and lid rim frictionally engage each other such that they form a first distal seal zone in the engaged rim structure. The one or more channels each form a partial discontinuity in this first distal seal zone. When the embodiment container is constructed in the fashion described above, the lid of the container remains engaged to the base, but allows the egress of gases and vapors inside the initially sealed container through the one or more vent channels upon the pressure in the sealed container reaching a certain level without manually repositioning of the lid on the base.

In the preferred embodiment container the lid rim has a lid retaining bead. The lid retaining bead has a peripherally projecting bottom segment, a peripherally projecting lid rim flange and an outer vertically oriented segment disposed between the peripherally projecting horizontal segment and the peripherally projecting lid rim flange. The base rim has a base retaining bead. The base retaining bead has a peripherally projecting platform segment, a peripherally projecting top segment and an inner vertical wall disposed between the peripherally projecting platform segment and the peripherally projecting top segment. In the initially sealed state the base rim and lid rim frictionally engage each other such that the peripherally projecting bottom segment of the lid rim and peripherally projecting platform segment of the base rim contact each other and form a first proximal seal zone. Additionally, in the initially sealed state the outer vertically oriented segment of the lid rim and the inner vertical wall of the base rim contact each other and form a second proximal seal zone. When the container is in the sealed state, the one or more channels found within the overlapping portion form a complete discontinuity in the first proximal seal zone and in the second proximal seal zone. In a more preferred embodiment of the container, when it is in the initially sealed state the base rim and lid rim frictionally engage each other such that the peripherally projecting lid rim flange of the lid rim and the peripherally projecting top segment of the base rim contact each other and form a first distal seal zone. The one or more channels found within the overlapping portion each form a partial discontinuity in the first distal seal zone.

As just described, the one or more vent channels are formed in either or both of the lid rim and base ring structures so as to create areas of discontinuity in the seal zones. These areas of discontinuity serve as channels in which pressurized vapor may travel out from the container and through the engaged rims of the sealed container. The channels are confined to the overlapping portion of the container, which in more specific detail is located in the area of the engaged rims proximate the hinge-forming structure and which are within the endpoints of both the first hinge-joining section and the second hinge-joining section. Preferably, these vent channels are located at a distance inboard from those endpoints such that they are not directly accessible by finger or implement. When the channels are so limitedly located, they are protected from access and manipulation by the hinge-forming structure of the container. Thus, pressurized vapor is emitted through the rims of the container and into the empty hinge space defined by the hinge-forming structure of the container. An initially sealed container thus fully retains its tamper evidence, but also allows for venting.

DETAILED DESCRIPTION

Figure 1:
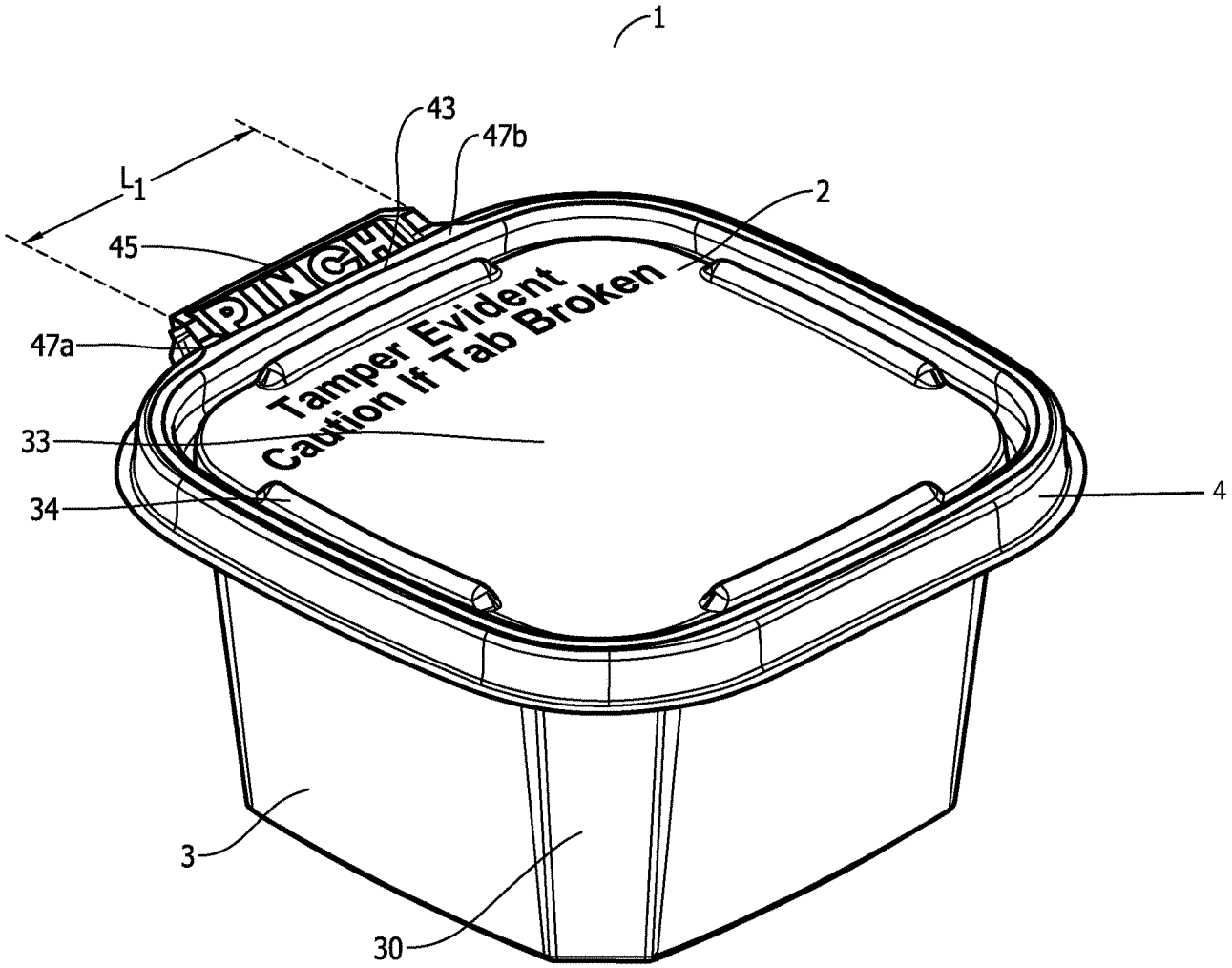
FIG. 1 is a perspective view of a preferred embodiment of the present invention container in the sealed state.
Figure 2:
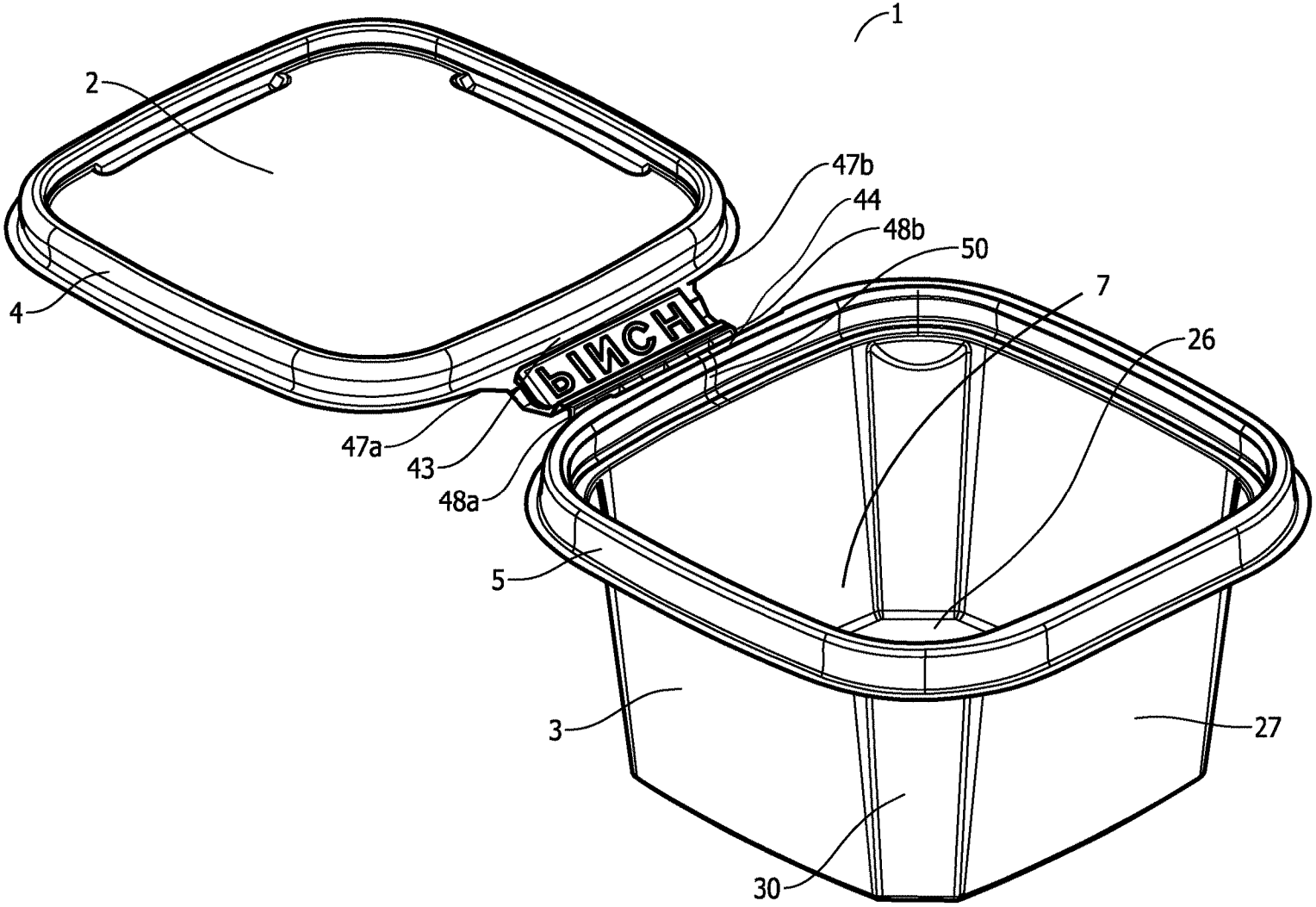
FIG. 2 is a perspective view of a preferred embodiment of the present invention container in the loading state.
Figure 5:
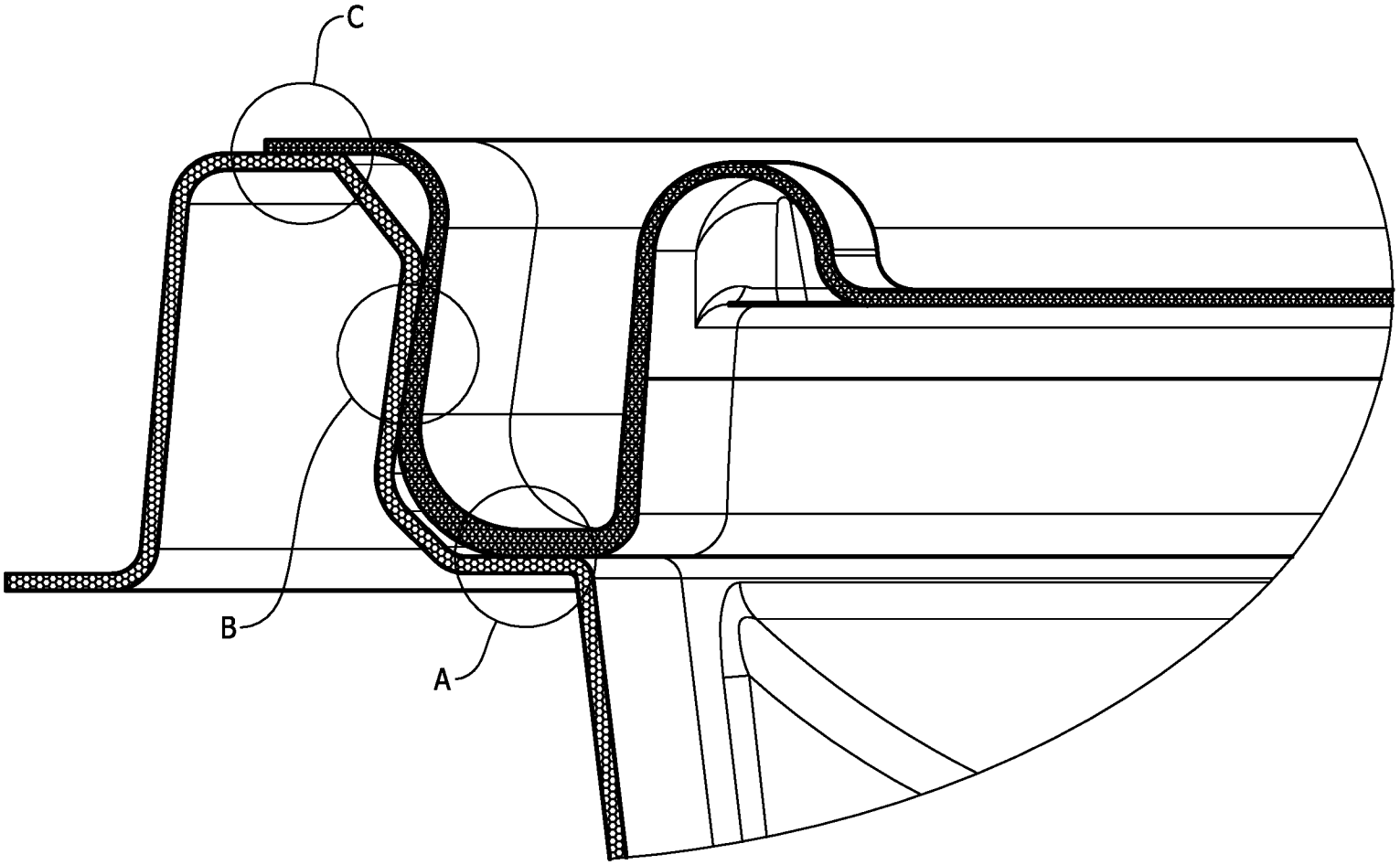
FIG. 5 is an identical image of e structure shown in FIG. 4 with the seal zones indicated instead.
Figure 6:
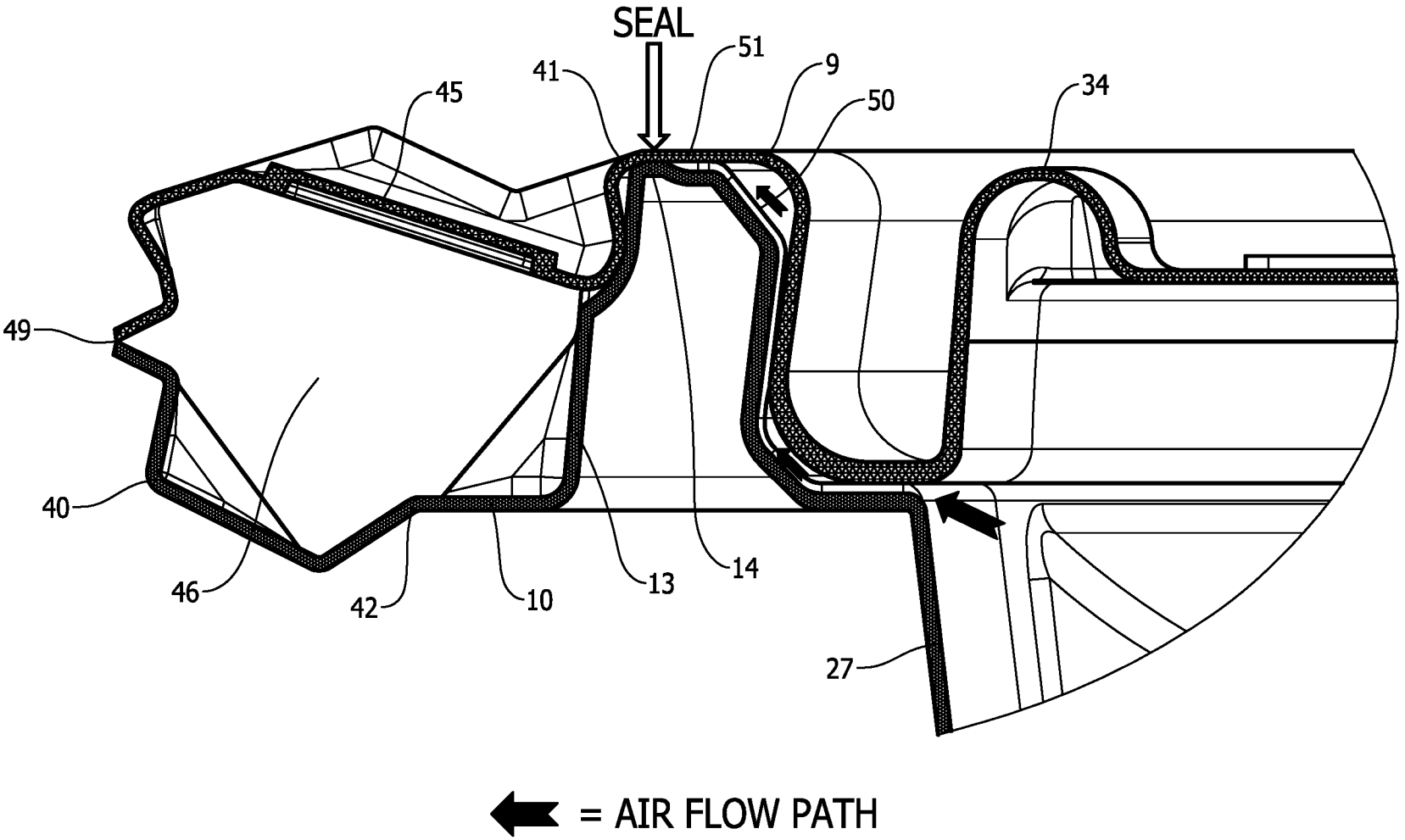
FIG. 6 is a detailed cross section view of the engaged rim structure proximate the hinge-forming structure of a preferred embodiment container in the sealed state.
Figure 7:
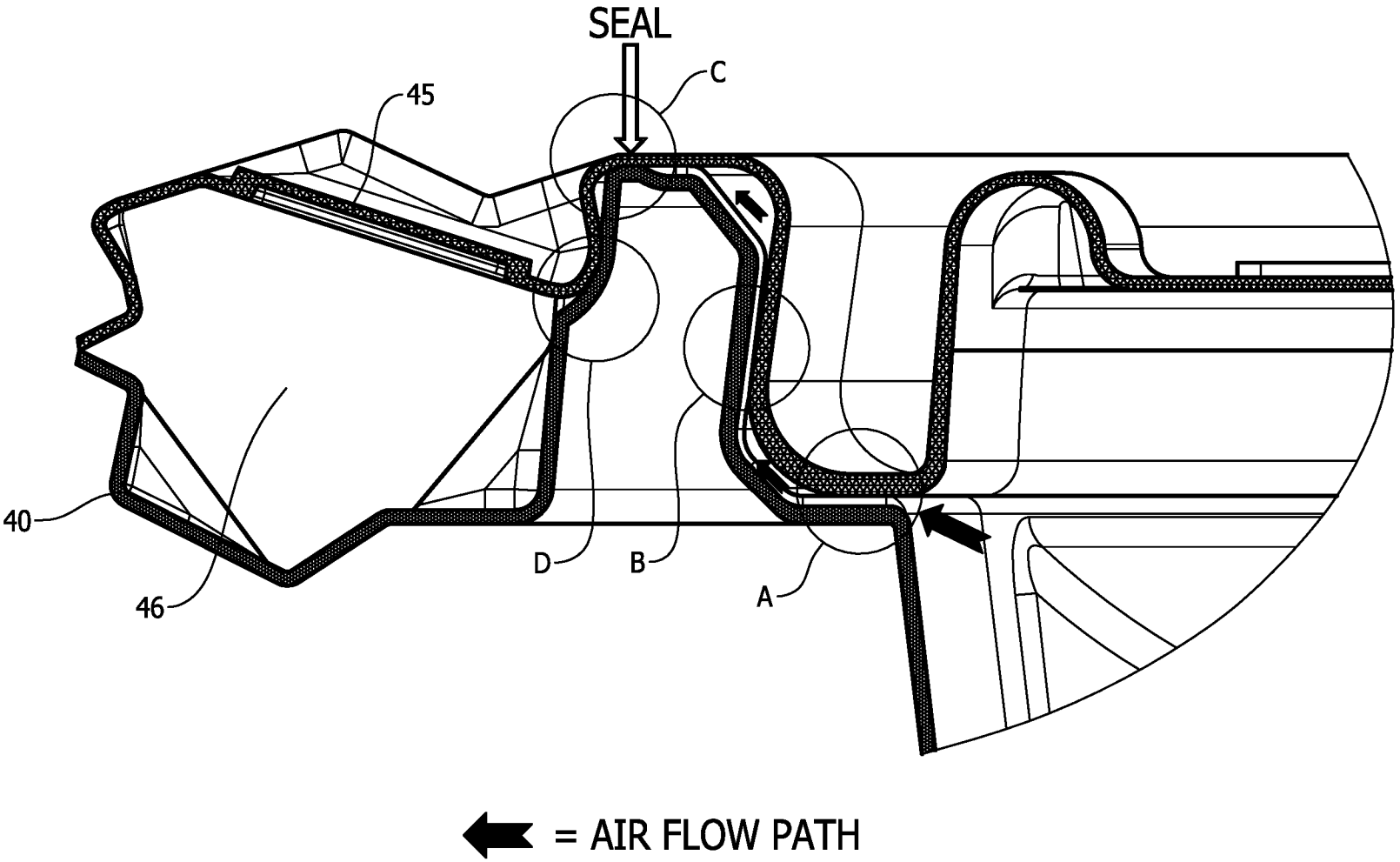
FIG. 7 is an identical image of the structure shown in FIG. 6 with the seal zones indicated.

A preferred embodiment container 1 of the present invention in the initially sealed state and loading state is shown in FIGS. 1 and 2. As seen in the figures, the inventive plastic food container is capable of assuming an initially sealed state and a loading state. In practical use, the outer surface of floor 26 of base 3 will normally rest upon a surface (such as a table top) considered horizontal in reference to the user. Thus, the directional terms "vertical" and "horizontal" and the like are used to describe the container 1 and its components with respect to the orientation illustrated in FIGS. 1-7 and are employed merely for the purposes of clarity and illustration. For example, FIG. 1 and FIGS. 6-7 show the container and the hinge area of container 1 when container 1 is in an initially sealed state. In the orientation shown in FIG. 6, lid flange 9 is "vertically" higher than base flange 10. The directional terms "inner" and "inwardly" and the like are used herein with respect to the described container to refer to directions along the directional component toward the geometric center of the container when lid 2 of container 1 is sealed or closed upon the base 3. Similarly, the directional terms "radially," "outer," "peripherally" and the like are used herein with respect to the described container to refer to directions along the directional component away from the geometric center of the container when lid 2 of container 1 is sealed or closed upon the base 3. Additionally, the terms "upward," "downward" and the like are used to describe spatial relationships among structure when lid 2 of container 1 is sealed or closed upon the base 3.

The container includes hinge-forming structure 40 that includes an opening mechanism 45 which an end user will use to open the container from the initially sealed state. In the case of the shown preferred embodiment container, the opening mechanism 45 is representatively shown to be that as depicted in U.S. Pat. No. 9,580,219 (Cimmerer, et al). This is merely exemplary as the invention described herein will work with containers using other opening mechanisms that are located in hinge-forming structure. When the opening mechanism 45 for the initially sealed container has been utilized, the container is then in a ready-to-open state. When the lid is separated from the base from this ready-to-open state, the container is in an opened state.

As shown by these figures, container 1 includes lid 2 and base 3. Lid 2 includes cover portion 33, which extends outwardly to form inner wall 18 of preferred embodiment multi-segment rim 4. Rim 4 preferably includes a bead formed from inner vertical wall 18, outer vertical wall 19 and peripherally projecting bottom segment 20 disposed in between inner wall 18 and outer wall 19. Lid 2 and base 3 are manufactured from a conventional plastic material. Lid 2 is preferably clear. Cover portion 33 may be flat or domed and may include cover bead 34 in accordance with the prior art to enhance such factors as restricting access to lid rim flange 9 and stacking of sealed containers. Base 3 has a base rim 5 that peripherally encompasses base 3 so as to form container cavity 7. Lid 2 has a lid rim 4 that peripherally encompasses lid 2.

The structure of preferred embodiment lid rim 4 will now be discussed in further detail. As best shown n FIGS. 4 and 5, lid rim 4 includes peripherally projecting bottom segment 20, which extends between inner wall 18 and outer wall 19, creating lid rim channel 23. The cross-section profile of segment 20 is generally horizontal. The profile, however, can be shaped to include structure such as ribbing, curves or bends to modulate rim strength, rigidity or flexibility so as to enhance the closing, sealing and opening functions of the rim as needed. The drawings depict a preferred embodiment cross-section profile of this peripherally projecting segment. As viewed in FIGS. 4 and 5 outer wall 19 extends upwardly between peripherally projecting segment 20 and peripherally placed and projecting flange 9. Outer wall 19 may be canted to better frictionally engage inner wall 12 of base rim 5 further described below.

Figure 4:
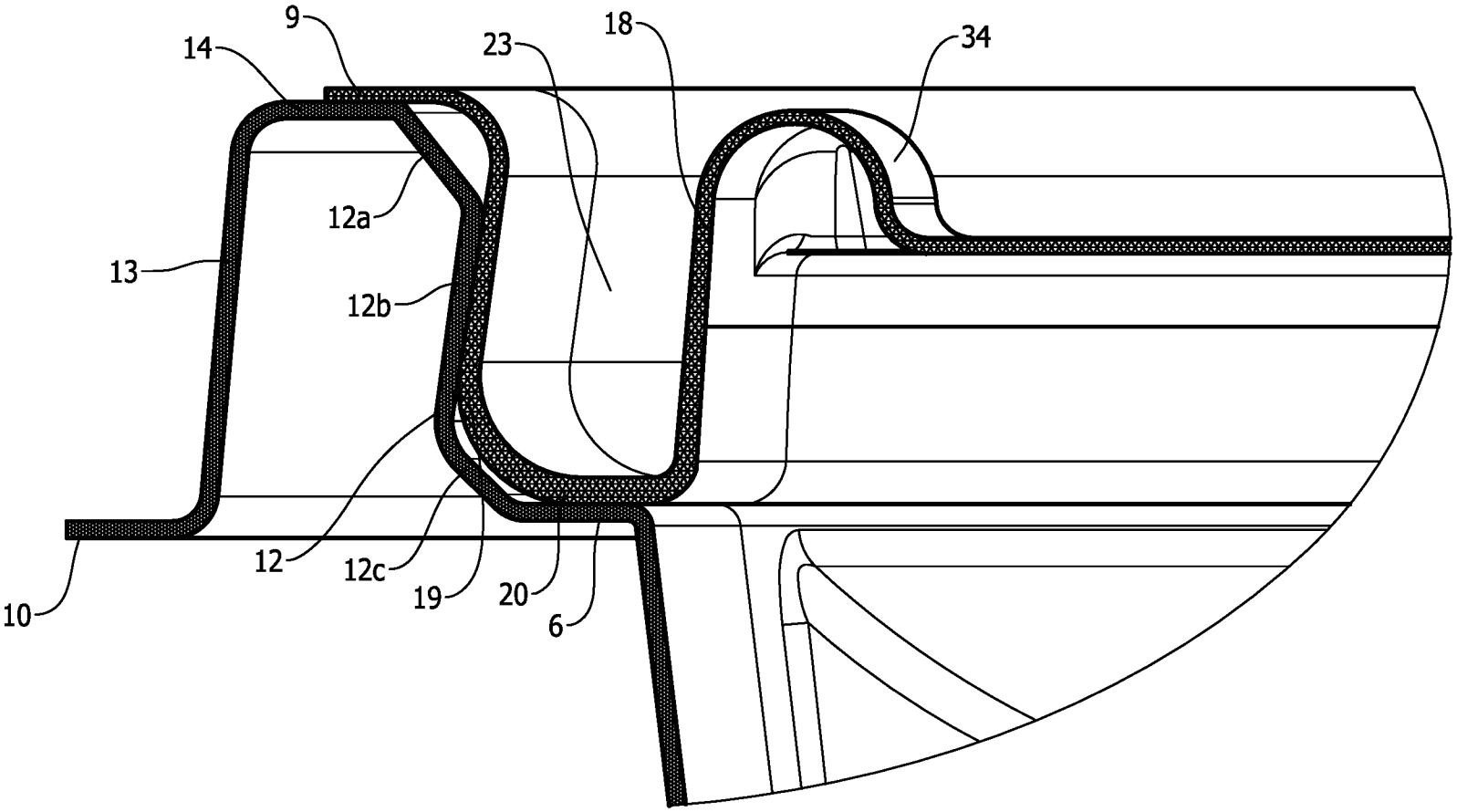
FIG. 4 is a detailed cross section view of the engaged rim structure outside of the area where hinge-forming structure connects to the container for a preferred embodiment container in the sealed state.

Base 3 includes a bottom-most level or floor 26 adjoined to sidewall 27. Sidewall 27 extends between base floor 26 and preferred embodiment, multi-segment rim 5. Sidewall 27 preferably includes beveled corners 30 for strength. Rim 5 includes ascending inner wall 12. The structure of preferred embodiment base 3 and its rim structure 5 are best shown in FIGS. 4 and 5. Base rim 5 includes peripherally projecting platform segment 6. Platform segment 6 curves upwardly to form inner wall 12. Inner wall 12 extends upwardly from peripherally projecting platform segment 6 to form peripherally projecting top segment 14. Inner wall 12 is preferably inwardly canted to provide maximum frictional engagement against outer wall 19. As viewed in FIG. 4, in the preferred embodiment peripherally projecting top segment 14 is horizontal and spans between inner wall 12 and outer wall 13. Rim 5 preferably includes peripheral flange 10, extending outwardly from base 3 from the bottom of outer wall 13.

As shown in the figures, in the preferred embodiment wall 12 comprises three sections: upper section 12*a*; middle section 12*b*; and lower section 12*c*. Upper section 12*a* is preferably formed as a chamfer between top segment 14 and middle wall section 12*b*. Lower section 12*c* curves or chamfers upward from platform 6 to middle section 12*b*. Middle section 12*b* is disposed between upper section 12*a* and lower section 12*c*. As seen in the figures and described below, the engagement of rims 4, 5 creates one or more proximal seal zones and one or more distal seal zones.

By virtue of the canting of inner wall 12 of rim 5 and outer wall 19 of rim 4, when container 1 is in the sealed state peripherally projecting segment 20 of lid rim 4 is pressed down upon and firmly contacts platform segment 6 of base rim 5 to form a first proximal seal zone A. In the preferred embodiment, this first proximal seal zone A is horizontally oriented. Also, when container 1 is in the sealed state, wall 12 (preferably at section 12*b*) of base rim 5 firmly contacts wall 19 of lid rim 4 to form a second proximal seal zone B. In the preferred embodiment, this second seal zone B is vertically oriented. By virtue of the shape and structure of the components of rims 4, 5, when lid 2 is sealed upon base 3, rims 4, 5 tightly engage. Thus, in the normally sealed state, the mating rim surfaces provide a leakproof seal. Additionally, when container 1 is in the sealed state, lid rim flange (an outer peripherally projecting segment) 9 contacts outer peripherally projecting top segment 14 of base rim 5 to form a first distal seal zone C. In the preferred embodiment, this first distal seal zone C is horizontally oriented. Flange 9 is accessible by those handling container 1, but its short length and the tight tolerances of the structures of rims 4, 5 make it very difficult to grasp.

Figure 3:
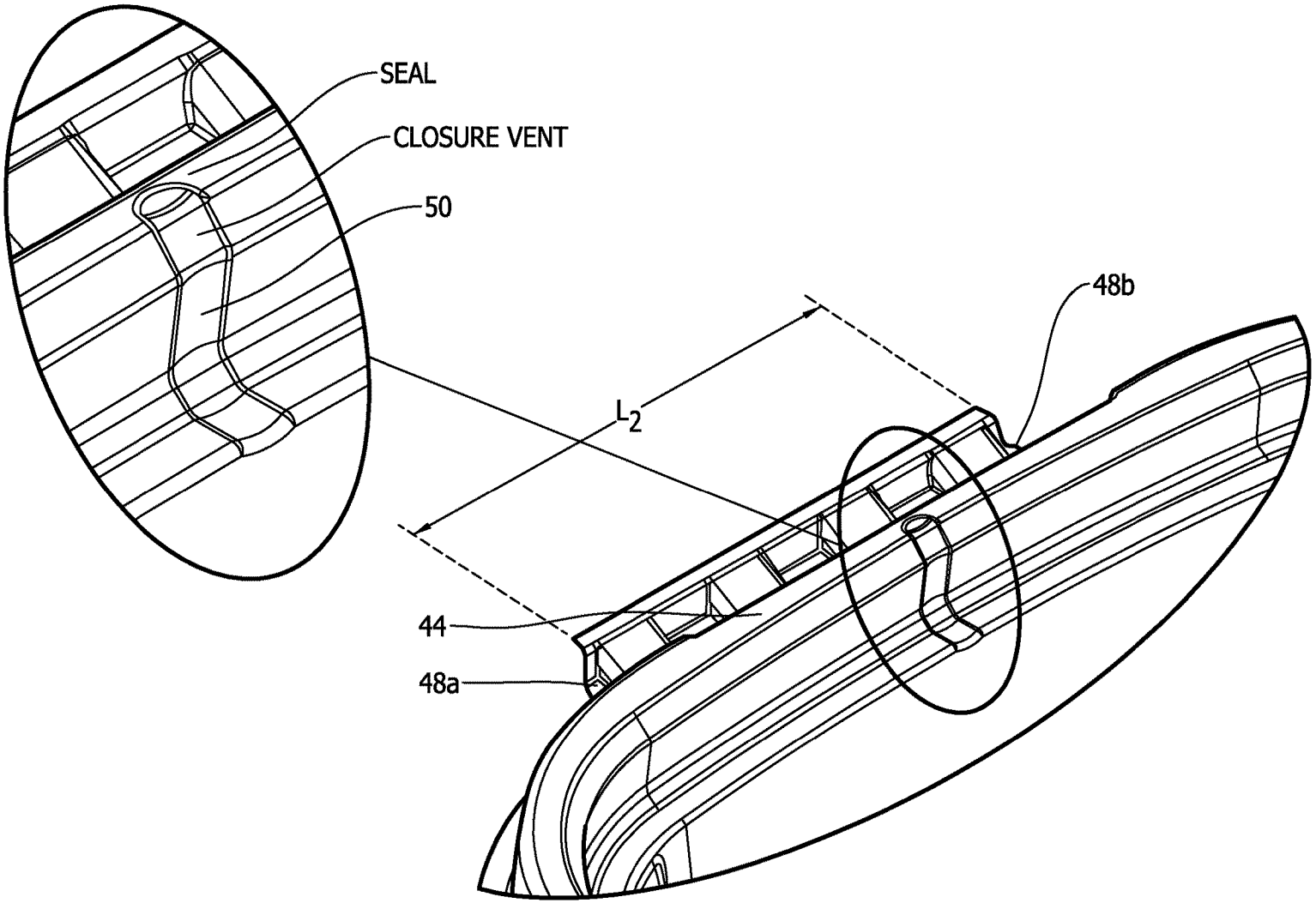
FIG. 3 is a detailed perspective view of the base rim with a vent channel formed therein of a preferred embodiment container of the present invention.

As shown in the FIGS. 6 and 7, container 1 also includes hinge-forming structure 40. Hinge-forming structure 40 extends from base rim 5 to distal point 49 and then returns to lid rim 4 and defines a contained hinge space 46. Hinge-forming structure 40 connects to lid rim flange 9 via transition section 41. Hinge-forming structure 40 connects to base rim flange 10 via transition section 42. Along its connection with lid rim 4, hinge-forming structure 40 defines a first hinge joining section 43 on lid rim 4. This is best shown in FIGS. 1 and 2. Similarly, along its connection with base rim 5, hinge-forming structure 40 similarly defines a second hinge-joining section 44 on base rim 5. This can be best seen in FIGS. 2 and 3. As is shown in FIG. 1, first hinge-joining section 43 has a length $L_1$ along lid rim 4 that extends between end points 47*a* and 47*b*. Second hinge-joining section 44 has a length $L_2$ that extends between end points 48*a* and 48*b* and is best seen in FIG. 3. In most containers, first hinge-joining section 43 will have the same length as that of hinge joining section 44. In other words, $L_1$ will equal $L_2$ and end points 47*a* and 48*a* will be vertically aligned, as will be end points 47*b* and 48*b*. In such case, first hinge joining section 43 and second hinge joining section 44 will also be completely vertically aligned and will fully overlap vertically. However, hinge forming structure 40 could be manufactured such that first hinge-joining section 43 and section hinge-joining section offset, of different lengths or both in which case first hinge-joining section and section hinge-joining section will only partially vertically overlap. In either case, in the initially sealed state the first hinge-joining-section 43 on lid rim 4 and second hinge-joining section 44 on base rim 5 will have a superposed position with respect to each other such that they define a vertically overlapping portion of the first and second hinge-joining sections. In the depicted preferred embodiment, because $L_1$ and $L_2$ have identical endpoints, overlapping portion on engaged container rims 4, 5 would be within the area demarcated by endpoints 47*a* and 47*b* and by endpoints 48*a* and 48*b*. Thus, in FIG. 3, the overlapping portion corresponds to the distance $L_2$ and in FIG. 1 where the container is shown in the initially sealed state, the overlapping portion corresponds to the distance $L_1$.

As seen in FIGS. 2 and 3, one or more vent channels 50 are formed in base 5 within second hinge-joining section 44. This is merely a representative the one or more vent channels 50 could be formed in the lid rim 4 within the first hinge-joining section 43. In the depicted preferred embodiment, a vent channel 50 is a groove disposed transversely in base rim 5. The one or more vent channels 50 are located on either or both of rims 4 or 5 such that they are within the confines (endpoints) of both hinge-joining sections 43 and 44 and such that they are within the vertically overlapping portion ($L_1$ in FIG. 1). Thus, when the container is in the sealed state, hinge-forming structure 40 is positioned adjacent to, but outwardly from one or more vent channels 50. More preferably, one or more vent channels will be located in the overlapping portion (coinciding with $L_1$ of FIG. 1) of rims 4, 5 sufficiently inboard from end points 47*a*, 47*b*, 48*a* and 48*b* to be out of reach of a handler's finger or any practically available tampering implement. This is best seen in FIG. 3. By being so located, the one or more vent channels 50 are not directly accessible to tampering because hinge-forming structure 40 would block the approach of any such finger or tool to the one or more vent channels 50. To reduce the chance of tampering, rims 4, 5 of preferred embodiment container 1 should not include a vent channel outside of the area defined as the vertically overlapping portion on engaged rims 4 and 5.

As seen in FIGS. 3 and 5, when the container is in the sealed state, the one or more channels form a complete discontinuity in the horizontal first proximal seal zone A and a complete discontinuity in the vertical second proximal seal zone B. In the preferred embodiment, the vent channel forms a partial discontinuity in the first distal seal zone C. The complete discontinuity in one or more proximal seal zones A and B creates a pathway from the interior of the container to one or more distal seal zones, first distal seal zone C through which pressurized vapors may flow. The pressure behind those vapors is sufficient to lift flange 9 off of top segment 14 of base rim 5. Once flange 9 lifts from top segment 14, the container vapors may exit container 1 and exhaust into hinge space 46. As seen in FIGS. 6 and 7, vent channel 50 modifies the shape of segment 14 so as to create a partial discontinuity 51 of seal zone C at the location of vent 50.

As shown in FIGS. 6 and 7, the container can be made with a second distal seal zone D preferably formed between transition segment 41 of hinge-forming structure 40 and outer wall 13 leading to flange 10. As in the case of first distal seal zone C, the pressure behind container vapors that is sufficient to separate transition section 41 off of top segment 14 of base rim 5 also separates segment 41 from its contact with wall 13. Once segment 41 separates from wall 13, the container vapors may exit container 1 and exhaust into hinge space 46. Thus, with the present invention container, the lid of the container is adapted to remain engaged to the base, but allow the egress of vapors inside the sealed container through the one or more vent channels 50 upon the pressure in the sealed container reaching a certain level without having to manipulate the lid on the base. The inclusion of one or more vent channel 50 in the overlapping portion of the container at the hinge joining area of the rims means that the proximal surfaces of rims 4, 5 can engage tightly around the periphery of the container seal the container and make it tamper proof. There is thus no secondary venting movement of the engaged rims at those proximal surfaces. Instead, the only secondary venting movement occurs at the distal areas of the engaged rims, past the position of a vent channel and only in the overlapping portion of the engage rims. Thus, this secondary movement is minimal compared to that of the prior art container. Once pressurized vapors have been purged, flange 9 and segment 41 assume their original sealed and leakproof state without manual intervention.

The vent feature described above means that a true tamper evident container can be provided with a venting mechanism that does not compromise the tamper evident quality of the container. The inventive container thus eliminates the need for a typical lid vent hole, which reduces the probability of tampering with the package contents after lidding. Additionally, the vent feature utilizes a seal area, between the vent groove and atmosphere, allowing the package to remain leak resistant while the contents are not under pressure. When the package contents create pressure, as in the case of cut fruit, the pressure is relieved as it forces open the seal area between the vent groove and the atmosphere. Additionally, if a consumer squeezes the sides of the package with too great a force, the vent feature allows pressure release before the lid might otherwise "pop" off the base. Placement of the vent feature, beneath the hinge, reduces visibility and detection of the feature. In carrying out the invention it is not important which rim, lid or base, is provided with the one or more venting channels 50. Accordingly, in another embodiment, outer wall 19 and segment 20 of lid rim 4 could be provided with venting channel 50.

A container constructed in accordance with the present invention can be manufactured in a variety of shapes and sizes, and is preferably formed of resins or plastic materials including, but not limited to, polyethylene, polypropylene, polyvinyl chloride or polyethylene terephthalate ("PET"). The container may be thermoformed, blow-molded or injection molded. The container lid and base can be transparent or translucent, and may be colored in either instance. Further, the container can be of any shape, including round or polygonal.

Having described the invention in detail, those skilled in the art will appreciate that modifications may be made of the invention without departing from its spirit. Therefore, it is not intended that the scope of the invention be limited to the specific embodiment illustrated and described.

What is claimed is:

1. A plastic food container capable of assuming a loading state and an initially sealed state in which the container rims are engaged, the container comprising:

a base and a lid;

the base having a base rim peripherally encompassing the base and the lid having a lid rim peripherally encompassing the lid;

hinge-forming structure extending from a first hinge-joining section of the lid rim to a second hinge-joining section on the base rim;

in the initially sealed state the first hinge-joining section superposing over all or part of the second hinge-joining section, the area at which the first hinge-joining-section superposes the second hinge joining section defining an overlapping portion of the first and second hinge-joining sections on the engaged rims;

in the initially sealed state the base rim and lid rim frictionally engage each other such that they form a first proximal seal zone horizontally oriented in the engaged rims and a second proximal seal zone vertically oriented in the engaged rims;

one or more vent channels formed in the base rim and located within the overlapping portion on the engaged rims; and when the container is in the sealed state, the one or more vent channels form a complete discontinuity in the first proximal seal zone and the second proximal seal zone.

2. The plastic food container of claim 1 wherein when the container is in the initially sealed state, the base rim and lid rim frictionally engage each other such that they form a first distal seal zone and the one or more channels each form a partial discontinuity in the first distal seal zone.

3. The plastic container of claim 2 wherein the first distal seal zone is horizontally oriented in the engaged rims.

4. The plastic food container of claim 3 wherein when the container is in the initially sealed state, the base rim and lid rim frictionally engage each other such that they form a second distal seal zone distal to the first distal seal zone.

5. A plastic food container capable of assuming a loading state and an initially sealed state in which the container rims are engaged, the container comprising:

a base and a lid;

the base having a base rim peripherally encompassing the base and the lid having a lid rim peripherally encompassing the lid;

hinge-forming structure extending from a first hinge, joining section to a second hinge-joining section;

the first hinge-joining section being connected to a length of the lid rim, the length of the lid rim being defined by endpoints on the lid rim;

the second hinge joining section being connected to a length of the base rim, the length of the base rim being defined by endpoints on the base rim;

in the initially sealed state the base rim and lid rim frictionally engage each other such that they form one or more proximal seal zones in the engaged rims;

one or more vent channels formed in either the lid rim or the base rim, the one or more vent channels being located between the endpoints on the first rim and between the endpoints on the second rim; and when the container is in the sealed state, the one or more vent channels form a complete discontinuity in the one or more proximal seal zones.

6. The plastic food container of claim 5 wherein the one or more proximal seal zones includes a first proximal seal zone that is horizontally oriented in the base rim.

7. The plastic food container of claim 5 wherein the one or more proximal seal zones includes a second proximal seal zone that is vertically oriented in the base rim.

8. The plastic food container of claim 5 wherein when the container is in the initially sealed state, the base rim and lid rim frictionally engage each other such that they form a first distal seal zone and the one or more channels each form a partial discontinuity in the first distal seal zone.

9. The plastic food container of claim 7 wherein when the container is in the initially sealed state, the base rim and lid rim frictionally engage each other such that they form a first distal seal zone and the one or more channels each form a partial discontinuity in the first distal seal zone.

10. The plastic food container of claim 8 wherein when the container is in the initially sealed state, the base rim and lid rim frictionally engage each other such that they form a second distal seal zone distal to the first distal seal zone.

11. The plastic food container of claim 9 wherein when the container is in the initially sealed state, the base rim and lid rim frictionally engage each other such that they form a second distal seal zone distal to the first distal seal zone.

* * * * *